US007621791B2

(12) United States Patent
Yazaki et al.

(10) Patent No.: US 7,621,791 B2
(45) Date of Patent: Nov. 24, 2009

(54) OUTBOARD ENGINE UNIT

(75) Inventors: Makoto Yazaki, Wako (JP); Kunihiro Kitsu, Wako (JP); Toru Kimura, Wako (JP); Masanori Tsubouchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 13 days.

(21) Appl. No.: 11/785,632

(22) Filed: Apr. 19, 2007

(65) Prior Publication Data

US 2007/0254539 A1 Nov. 1, 2007

(30) Foreign Application Priority Data

May 1, 2006 (JP) ..... 2006-127504
May 1, 2006 (JP) ..... 2006-127667

(51) Int. Cl.
*B63H 20/32* (2006.01)

(52) U.S. Cl. ..... 440/77

(58) Field of Classification Search ..... 440/76, 440/77; 123/195 C, 195 P, 198 C; 24/621
See application file for complete search history.

(56) References Cited

U.S. PATENT DOCUMENTS 4,348,194 A * 9/1982 Walsh ..... 440/77
4,708,673 A 11/1987 Dunham et al.
5,055,074 A * 10/1991 Westberg et al. ..... 440/77
5,069,643 A * 12/1991 Westberg et al. ..... 440/77
5,360,358 A * 11/1994 Haman ..... 440/77
5,560,247 A * 10/1996 Koishikawa et al. ..... 73/863.81
6,846,211 B2 * 1/2005 Yasuda et al. ..... 440/77
6,878,022 B2 * 4/2005 Yasuda et al. ..... 440/76
7,069,895 B2 * 7/2006 Itoh et al. ..... 123/198 E

FOREIGN PATENT DOCUMENTS

EP 1 116 865 A2 7/2001
EP 1 382 815 A1 1/2004
JP 2001-115817 4/2001
JP 2001-199393 7/2001
JP 2004-338463 12/2004

* cited by examiner

*Primary Examiner*—Lars A Olson
(74) *Attorney, Agent, or Firm*—Arent Fox LLP

(57) ABSTRACT

In an outboard engine unit, a cover assembly, defining a lower half section of an engine room, is composed of left and right cover members each formed of resin, and a bracket is fixed to a rear portion of the engine or engine support structure. The left and right cover members are fixed at their respective rear portions to the bracket. Centerline of an engine cylinder is offset from a centerline of the engine room toward one of left and right sides of the unit, and an ignition plug is provided on the other side opposite from the one side toward which the engine cylinder centerline is offset.

11 Claims, 11 Drawing Sheets

OUTBOARD ENGINE UNIT

FIELD OF THE INVENTION

The present invention relates to an outboard engine unit in which left and right cover members, defining a lower half section of an engine room, are mounted to and supported by an engine or engine support structure, and which facilitates detachment/re-attachment of left and right cover members. The present invention also relates to an outboard engine unit which facilitates maintenance work, such as detachment/attachment of an ignition plug.

BACKGROUND OF THE INVENTION

In recent years, there have been known outboard engine units of a type in which a lower half section of an engine room is defined by a lower cover composed of resin-made left and right (i.e., port- and starboard-side) cover members (e.g., Japanese Patent Application Laid-Open Publication Nos. 2004-338463 and 2001-199393 which will hereinafter be referred to as patent literature 1 and patent literature 2, respectively).

In the outboard engine unit disclosed in patent literature 1, the left and right cover members of the lower cover are bolted together in directly-abutted relation to each other. In the outboard engine unit disclosed in patent literature 2, an under cover (i.e., lower cover) is fixed to an engine body, and left and right cover halves (i.e., left and right cover members) of the under cover are bolted together in abutted relation to each other.

With both of the outboard engine units disclosed in patent literature 1 and patent literature 2, it is necessary to position a fixed section of the body of the outboard engine unit close to respective abutting portions of the left and right cover members, in order to reliably achieve appropriate abutment between the abutting portions of the cover members; actually, the left and right cover members are fastened together by common bolts passed through their respective abutting portions and fixed section.

However, with the aforementioned conventionally-known outboard engine units, when one of the left and right cover members is removed or detached for desired maintenance work, fixation of the other cover member would become unstable. Thus, in re-assembling of the cover, properly positioning the left and right covers etc. would require a considerable time and labor, which disadvantageously results in poor workability.

In the aforementioned conventionally-known outboard engine units, there are further provided an auxiliary exhaust outlet for discharging a portion of engine exhaust to the outside, and a water pilot hole for discharging a portion of engine cooling water to the outside of the engine room. Sealing structure for sealing the auxiliary exhaust outlet is attached to either or both of the abutting portions of the port-side and starboard-side cover members. Thus, when any of the cover members is to be detached, it is also necessary to detach the sealing structure, and thus, the detaching operation and subsequent re-assembling operation would become cumbersome, which disadvantageously result in poor workability. Further, a tube of the water pilot hole (hereinafter "water pilot tube") etc. are supported directed by the left and right cover members. Thus, when any of the cover members is to be detached, there arises a need to detach the water pilot tube, and thus, the detaching operation and subsequent re-assembling operation would become cumbersome, which also disadvantageously result in poor workability.

There have also been known outboard engine units of a type in which the axis of engine cylinders is offset relative to the axis of a crankshaft (e.g., Japanese Patent Application Laid-open Publication No. 2001-115817, which will hereinafter be referred to as patent literature 3). According to the disclosure of patent literature 3, the engine cylinder axis is offset relative to the crankshaft axis by a predetermined distance in a direction where a thrust force acts on a piston. Ignition plug is provided on the inner surface of a cylinder head. Thus, in order to secure a sufficient space for performing maintenance work of the ignition plug, it is necessary to (a) increase the size of a bottom cowling (i.e., lower cover) to thereby secure a sufficient space within the bottom cowling, or (b) lower the lower end position of a top cowling (i.e., engine cover) so that the ignition plug is exposed sideways when the top cowling is removed.

If the above (a) option is taken, the increased size of the bottom cowling leads to an increased size of the top cowling because the bottom cowling and top cowling are vertically joined together in edge-to-edge abutted relation, with the result that the overall size of the outboard engine unit and weight of the top cowling would significantly increase. Further, if the above (b) option is taken, lowering the lower end position of the top cowling leads not only to an even greater concave depth of the top cowling, having a deep bowl shape, but also to an increased size and weight of the top cowling, as a result of which operation for detaching the top cowling tends to be cumbersome and troublesome.

Generally, the outboard engine units employ a vertical engine with a vertically-oriented crankshaft and horizontally-oriented cylinders; especially, the high-power outboard engine units employ a four-stroke engine with a plurality of cylinders. In such outboard engine units, a plurality of cylinders (e.g. four cylinders in the case of a four-cylinder engine) are disposed in a vertical arrangement with a great vertical interval between the uppermost cylinder and the lowermost cylinder. With such plural-cylinder engines, the engine body unavoidably has an increased vertical length, as a result of which the bow-shaped top cowling tends to have an even greater depth.

SUMMARY OF THE INVENTION

In view of the foregoing prior art problems, it is an object of the present invention to provide an improved outboard engine unit which allows any one of left and right cover members to be readily detached and re-attached, without adversely influencing the other cover member and without being interfered with by the presence of an exhaust outlet port and water pilot hole, and thereby permits disassembly/re-assembly of the cover.

It is another object of the present invention to provide an improved outboard engine unit which allows maintenance work of an ignition plug, disposed in a lower region within an engine room, to be performed with an increased ease without a need for substantially lowering the lower end position of an engine cover (top cowling), and which allows maintenance work of an ignition plug to be performed with ease without a need for disassembling or detaching a lower cover (bottom cowling).

According to one aspect of the present invention, there is provided an improved outboard engine unit, which comprises: a cover assembly defining a lower half section of an engine room having an engine accommodated therein, the cover assembly being composed of left and right cover members each formed of resin; and a bracket fixed to a rear portion of the engine or engine support structure, the left and right cover members being fixed at respective rear portions thereof to the bracket.

In the outboard engine unit of the invention, where the bracket is fixed to a rear portion of the engine or engine support structure and the left and right cover members are fixed at their respective rear portions to the bracket, each one of the left and right cover members can be detached and re-attached from and to the bracket independently of the other of the cover members. Thus, the present invention can significantly facilitate disassembly and re-assembly of the cover assembly, e.g. for maintenance work, and achieve greatly-enhanced workability, as compared to the prior art. Further, because it is only necessary to provide the bracket, fix the bracket to a rear portion of the engine or the like, abut the respective joining edges against the bracket and then individually fix the joining edges of the cover members to the bracket by means of a bolt or otherwise. Thus, the present invention can significantly simplify the abuttingly-joining construction of the cover members and hence the construction of the outboard engine unit.

In an embodiment of the invention, the bracket has engaging grooves, formed in its opposite side edges, for engaging the predetermined joining edges of the left and right cover members. With the engaging grooves formed in the bracket to engage with the joining edges of the left and right cover members, the present invention allows the left and right cover members to be attached to the bracket with an enhanced reliability, and with an increased ease by being guided by the engaging grooves.

In an embodiment of the invention, the left and right cover members have respective joining portions overlapping with each other, each of the joining portions having a tapering hole. The left and right cover members are fastened together by a bolt screwed through the tapering holes of the left and right cover members, initially displaced from each other in a left-right direction of the outboard engine unit, to a predetermined fixed threaded portion to tighten the respective joining portions against the bracket and thereby press the left and right cover members toward each other. With the bolt passed through the initially-horizontally-displaced tapering holes of the left and right cover members to tighten the respective joining portions against the bracket, the left and right cover members are drawn toward each other through a kind of wedge action. Thus, the present invention allows the left and right cover members to be readily fixed to the bracket in a simplified manner with an enhanced reliability. The bracket may have a lock device provided thereon for locking an engine cover, in which case the present invention can eliminate a need for providing, on the cover assembly, a base plate and structure dedicated to a lock device and permits shared use of the components between the bracket and the cover assembly.

According to another aspect of the present invention, there is provided an improved outboard engine unit, which comprises: a cover assembly defining a lower half section of an engine room having an engine accommodated therein, the cover assembly being composed of left and right cover members each formed of resin; and a bracket fixed to a rear portion of the engine or engine support structure, the bracket having an auxiliary exhaust port provided therein for discharging a portion of exhaust of the engine to outside of the engine room.

With the auxiliary exhaust port provided in the bracket for discharging a portion of the engine exhaust to the outside of the engine room, it is not necessary to provide a sealing structure for the auxiliary exhaust port on any one of the left and right cover members. Thus, the present invention can eliminate the need for detaching elements of the auxiliary exhaust port and sealing structure each time at least one of the left and right cover members is to be detached and the need for re-attaching the elements of the auxiliary exhaust port and sealing structure in re-assembly of the cover assembly, thereby achieving enhanced workability.

According to still another aspect of the present invention, there is provided an improved outboard engine unit, which comprises: a cover assembly defining a lower half section of an engine room having an engine accommodated therein, the cover assembly being composed of left and right cover members each formed of resin; and a bracket fixed to a rear portion of the engine or engine support structure, the bracket having a water pilot hole provided therein for discharging a portion of cooling water of the engine to outside of the engine room.

With the water pilot hole section provided in the bracket for discharging a portion of the engine cooling water to the outside of the engine room, it is not necessary to detach the water pilot tube, unlike in the prior art construction where the water pilot etc. are supported directed by the left and right cover members. Thus, the present invention can greatly facilitate detachment/reattachment of any of the cover members, thereby achieving enhanced workability.

According to still another aspect of the present invention, there is provided an improved outboard engine unit, which comprises: an engine room having an engine accommodated therein, a centerline of an engine cylinder being offset from a centerline of the engine room toward one of left and right sides of the outboard engine unit; and an ignition plug provided on other of the left and right sides, opposite from the one side toward which the centerline of the engine cylinder is offset. With the ignition plug provided on the opposite side from the side toward which the centerline of the engine cylinder is offset, the side in the cylinder head, where the ignition plug is provided, can have a greater space, so that maintenance of the ignition plug can be performed with an increased ease.

In en embodiment, the engine room is defined by a lower cover and an upper or engine cover joined to the lower cover from above, and the lower cover has a recessed section formed in a portion thereof coinciding with a pulled-out direction of the ignition plug, the recessed section being openable/closeable by a lid. By the provision of the recessed section, the above-mentioned space need not be great more than necessary, which thus facilitates reliable sealing of the recessed section. Further, with the lid opening/closing the recessed section as desired, maintenance of the ignition plug can be performed with an even further increased ease.

In an embodiment, the lower cover comprises left and right cover members each formed of resin, and one of the left and right cover members has the recessed section formed therein and the lid provided thereon. Because the recessed section and the lid have to be provided on only one of the cover members, the recessed section and the lid can be handled integrally with the one cover member when the cover member is to be detached or re-attached, with the result that detachment and re-attachment of the cover member can be performed with utmost ease.

In an embodiment, the outboard engine unit of the invention may further comprise a bracket fixed to a rear portion of the engine or engine support structure. In this case, the left and right cover members of the lower cover are fixed to the bracket, and the plug is disposed in such a manner that the pulled-out (i.e., insertion/removal) direction of the ignition plug does not coincide with the location of the bracket. Thus, the present invention can not only facilitate disassembly/re-assembly of the lower cover for generally the same reasons as set forth above, but also facilitate maintenance work of the ignition plug without involving interference between the bracket and the ignition plug. At the time of the maintenance work of the ignition plug time, the left and right cover members and the bracket may be kept installed in position (i.e., need not be detached).

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
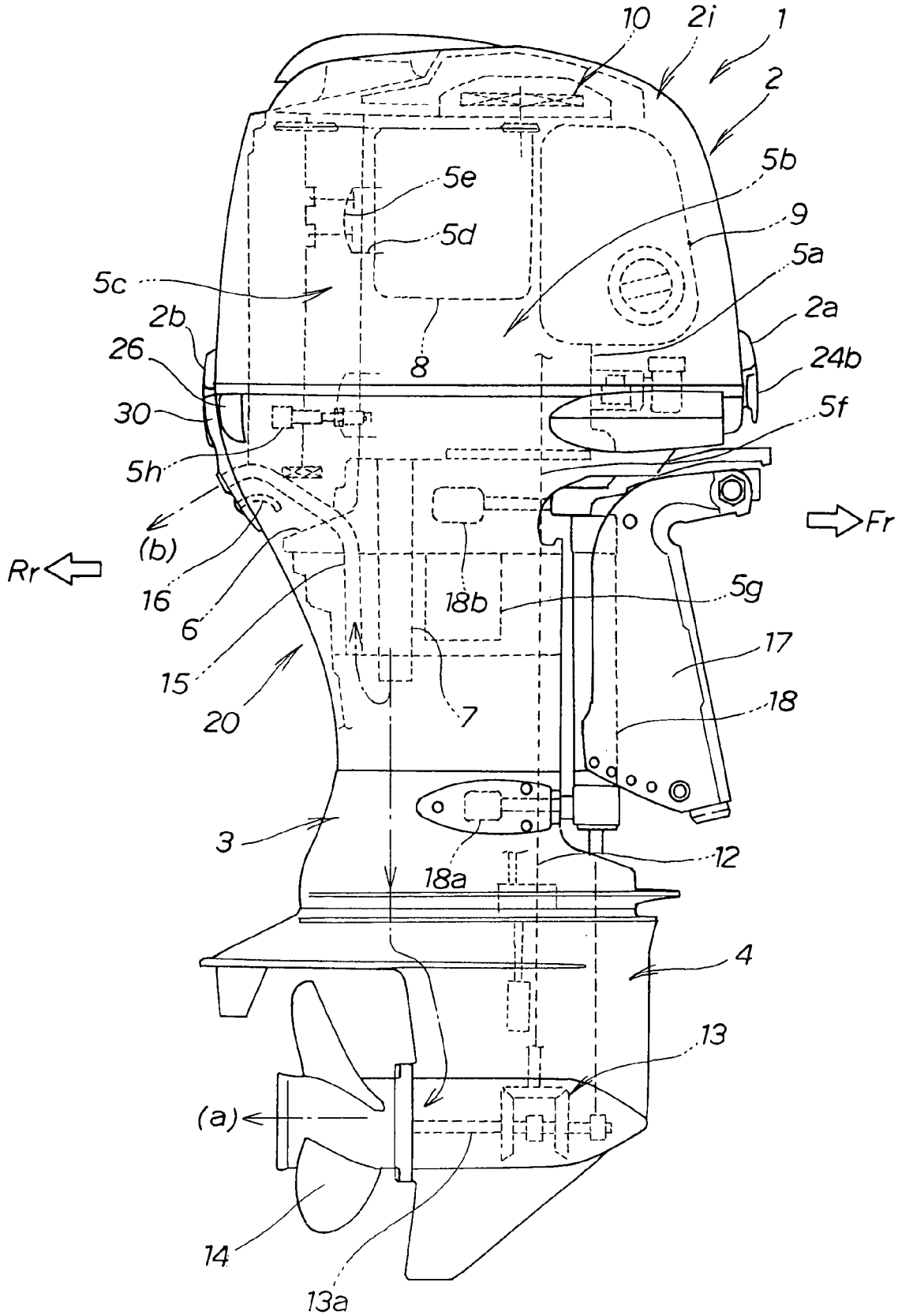
FIG. 1 is a side view showing an outboard engine unit in accordance with an embodiment of the present invention, in which inner mechanisms are indicated by broken lines.
Figure 2:
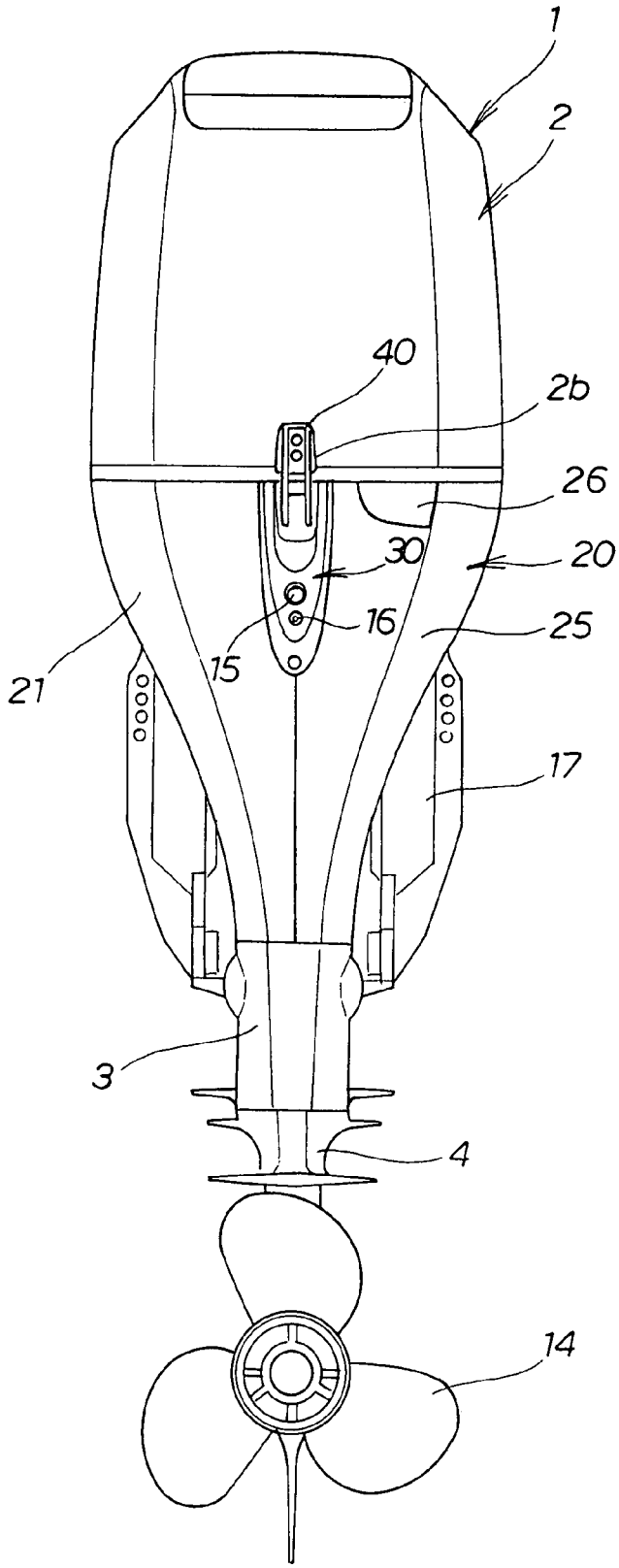
FIG. 2 is a rear view showing an external appearance of the outboard engine unit of FIG. 1.
Figure 3:
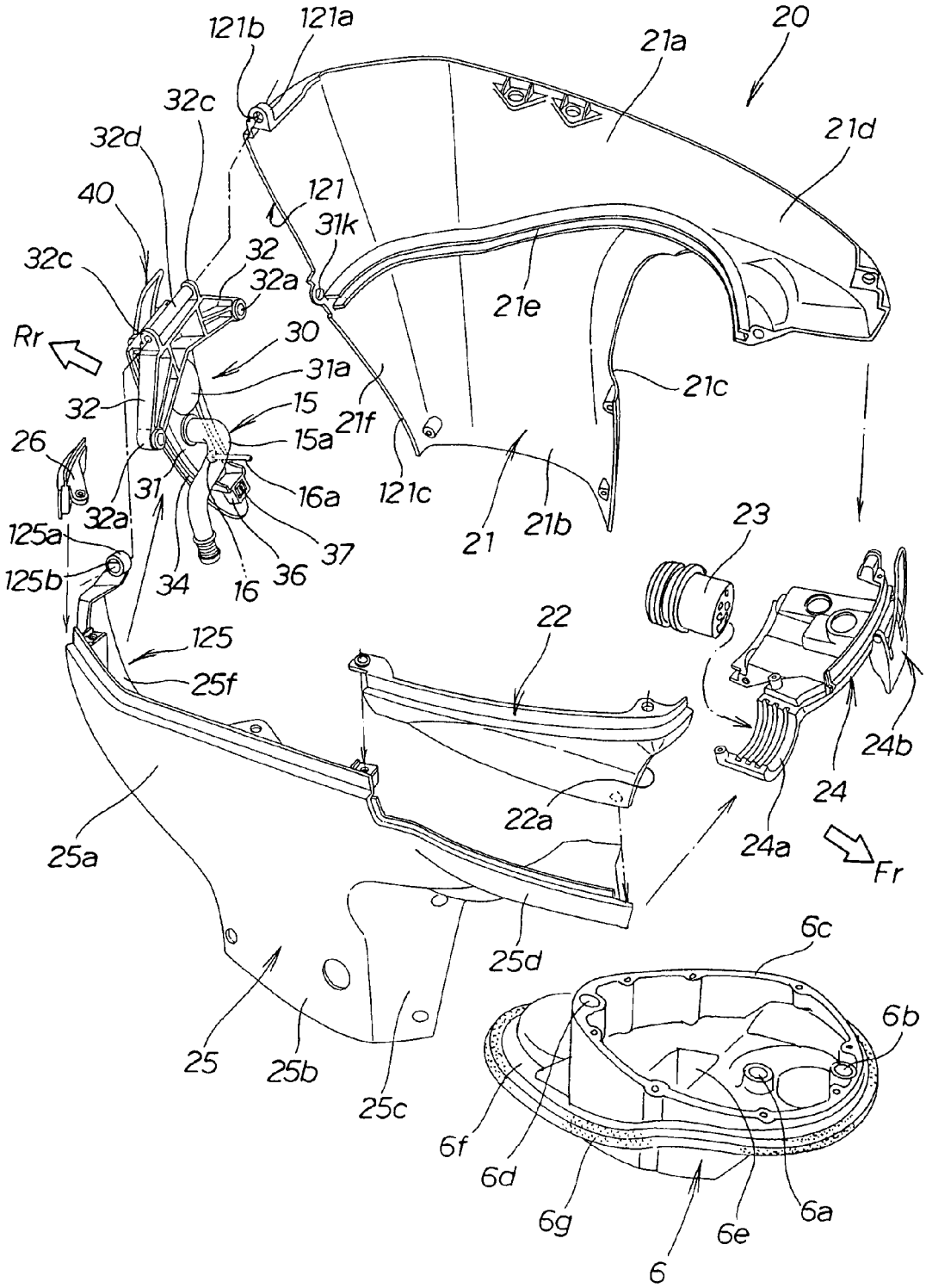
FIG. 3 is an explosive perspective view of a lower cover of the outboard engine unit, which particularly shows an engine support member, front and rear brackets, etc.

Reference is now made to FIG. 1 to FIG. 3 inclusive, wherein FIG. 1 is a side view showing an outboard engine unit 1 in accordance with an embodiment of the present invention, in which inner mechanisms are indicated by broken lines, FIG. 2 is a rear view showing an example external appearance of the outboard engine unit 1, and FIG. 3 is an explosive perspective view of a lower cover (or lower cover assembly) 20 of the outboard engine unit 1, which particularly shows an engine support member, front and rear brackets, etc.

In the figure, "Fr" represents a forward propelled direction of a boat to which is applied the outboard engine unit of the present invention, while "Rr" represents a rearward direction opposite from the forward propelled direction of the boat.

Example external appearance of the outboard engine unit 1 is shown in the side view of FIG. 1 and rear view of FIG. 2. As shown, the outboard engine unit 1 includes an engine cover 2 disposed in the uppermost position of the unit 1 and a lower cover (assembly) 20, and these upper engine cover 2 and lower cover 20 together define an engine room 2*i*. Extension case 3 is provided under the lower cover 20, and a gear case 4 disposed in the lowermost position of the unit 1 is joined to the lower end of the extension case 3.

Engine 5 is accommodated and supported within an upper area of the engine room 2*i*, defined by the upper and lower covers 2 and 20, via an engine mount case (i.e., engine support structure) 6 disposed within the lower cover 20. The engine 5, which is in the form of a so-called vertical engine having a vertically-oriented crankshaft 5*f*, is a four-stroke engine with a plurality of cylinders (e.g., four cylinders in the instant embodiment) 5*d* that are disposed in a vertical arrangement.

The engine 5 includes a front crankcase 5*a*, intermediate cylinder block 5*b*, rear cylinder head 5*c*, etc. Exhaust directed downward from the cylinder head 5*c* sequentially passes through an exhaust passageway in the engine mount case 6, exhaust pipe 7 downstream of the engine mount case 6, lower space in the lower cover 20, extension case 3 and then gear case 4, so that it is ultimately discharged, as main exhaust, into the outside water through a center region of a screw 14.

A plurality of cylinders 5*d* are provided in the cylinder block 5*b*—in the instant embodiment, four horizontally-oriented cylinders 5*d* are disposed in a vertical arrangement—, and a plurality of combustion chambers 5*e*, openable and closeable with air intake and exhaust valves, are provided in the cylinder head 5*c*.

In a ride-side section of the cylinder block 5*b*, there is accommodated an electric component box 8 containing a circuit board for performing control of an engine ignition device and fuel injection device. Further, an intake silencer 9 is provided in front of the electric component box 8 and extends along a side of the crankcase 5*a* to a region in front of the crankcase 5*a*, and a power generator (A.C. generator) 10 is disposed over the engine 5.

The crankshaft 5*f* extending vertically through the interior of the crankcase 5*a* of the engine 5 has its lower end portion connected to a vertical drive shaft 12, and the drive shaft 12 is connected at its lower end portion connected to a gear transmission mechanism 13 accommodated in the gear case 4. The gear transmission mechanism 13 transmits power, delivered from the drive shaft 12, to a horizontal driven shaft 13*a* provided in the gear case 4 in a front-end orientation. Rear end portion of the driven shaft 13*a* projects rearwardly beyond the rear end of the gear case 4, and a propeller 14 is fixed to the rear end portion of the driven shaft 13*a*. The propeller 14 is driven by the power of the engine 5, and switching is made, via a pair of dog clutches, between forward and reverse rotating directions of the propeller 14 so that a forward or rearward propelling force can be obtained as desired.

Exhaust from the above-mentioned main exhaust pipe 7 is directed downward as indicated by arrow (a) and then discharged to the outside through the center region of the screw 14, and a portion of the exhaust is discharged to an outside region posterior to the outboard engine unit 1 as indicated by arrow (b). Exhaust passageway is provided in the mount case 6 adjacent to the main exhaust pipe 7, and an auxiliary exhaust port or pipe 15 is provided adjacent to a downstream outlet of the main exhaust pipe 7. The auxiliary exhaust pipe 15, which is formed of vinyl chloride and rubber, extends in the interior of the engine mount case 6 while being bent rearwardly and opens to the outside through a wall of the lower cover 20 to discharge the exhaust to an outside region posterior to the outboard engine unit 1 as indicated by arrow (b).

The lower cover (assembly) 20 has a water pilot hole section 16 provided therein and having a hole formed therein to open to the outside, and the water pilot hole section 16 discharges a portion of engine cooling water to the outside (downwardly from the lower cover 20) to permit a visual check as to whether the cooling water is appropriately flowing to an engine cooling section.

Stern bracket 17 is supported on a front end portion of the outboard engine unit 1 via a swivel case 18. Reference numerals 18*a* and 18*b* represent mount rubbers for supporting the swivel case 18, 5*g* an oil pan, and 5*h* an ignition plug.

Referring now to FIG. 2, the upper cover 2, of the covers defining the engine room 2*i*, is formed integrally of resin, while the lower cover (assembly) 20 comprises left and right i.e., port-side and starboard-side) cover members (or cover halves) integrally joined together in abutted relation to each other. The left and right cover members or halves) are each molded of resin.

The following paragraphs describe an example construction of the lower cover (assembly) 20, with primary reference to FIG. 3.

The lower cover 20 comprises left and right cover halves 21 and 25 each having a semi-oval shape as viewed in plan. Upper half sections 21*a* and 25*a* of the left and right lower cover halves 21 and 25 are elongated in shape in the front-rear direction of the unit 1, and lower half sections 21*c* and 25*c* of the left and right lower cover halves 21 and 25 have shorter lengths, in the front-rear direction, than the upper half sections 21*a* and 25*a*. More specifically, front portions of the lower half sections 21*c* and 25*c* of the left and right lower cover halves 21 and 25 are recessed rearwardly, and front portions 21*d* and 25*d* of the upper half sections 21*a* and 25*a* projected forwardly. The left and right lower cover halves 21 and 25 also have engaging portions in the form of grooves (only the groove 21*e* of the left cover half 21 is shown in FIG. 3) formed in their opposed inner surfaces and located in left-right symmetrical relation to each other (although not visible in the figure, the inner engaging groove of the right cover half 25 is formed in a position corresponding to the inner engaging groove 21*e* of the left cover half 21). When the left and right cover halves 21 and 25 are joined together in edge-to-edge abutted relation to each other, a sealing member 6*g*, which is provided on and along a peripheral flange portion 6*f* of the engine mount case 6, is fitted in the above-mentioned inner engaging grooves, to provide hermetic sealing between the engine mount case 6 and the lower cover (assembly) 20.

As further shown in FIG. 3, the engine mount case 6 has a hole 6*b* through which a shift rod passing through a swivel shaft vertically extends, a hole 6*a* through which the drive shaft vertically extends, an engine-mounting flange 6*c*, an opening for returning oil to the oil pan 6*e*, a hole 6*d* through which the main exhaust pipe 7 vertically extends, etc.

Further, the front portion 25*b* of the upper section 25*a* of the right cover half 25 is recessed downwardly, and a harness cover 22 is put on and integrally secured to the recessed part of the front portion 25*b* to provide the complete right cover half 25.

In FIG. 3 the front bracket 24 is positioned between the front ends of the front portions 21*d* and 25*d* when the left and right cover halves 21 and 25 are joined together in abutted relation to each other. The front bracket 24 includes an upwardly-oriented semicircular support arm 24*a* on its starboard side. Rubber-made cable bundle holder 23 is held or sandwiched between the upwardly-oriented semicircular support arm 24*a* and a downwardly-oriented semicircular recessed portion 22*a* formed in a front end portion of the harness cover 22, to hold the cable bundle in such a manner that the cable bundle can be introduced or withdrawn to or from the engine room 2*i*. The front bracket 24 also includes an operation arm 24*b* having a lock lever engageable, by operation of a handle, with a hook 2*a* (FIG. 1) provided on a front end portion of the upper cover 2.

The left and right cover halves 21 and 25 of the lower cover 20 have rear upper abutting (joining) portions that are joined to the rear bracket 30 as will be later detailed.

Figure 4:
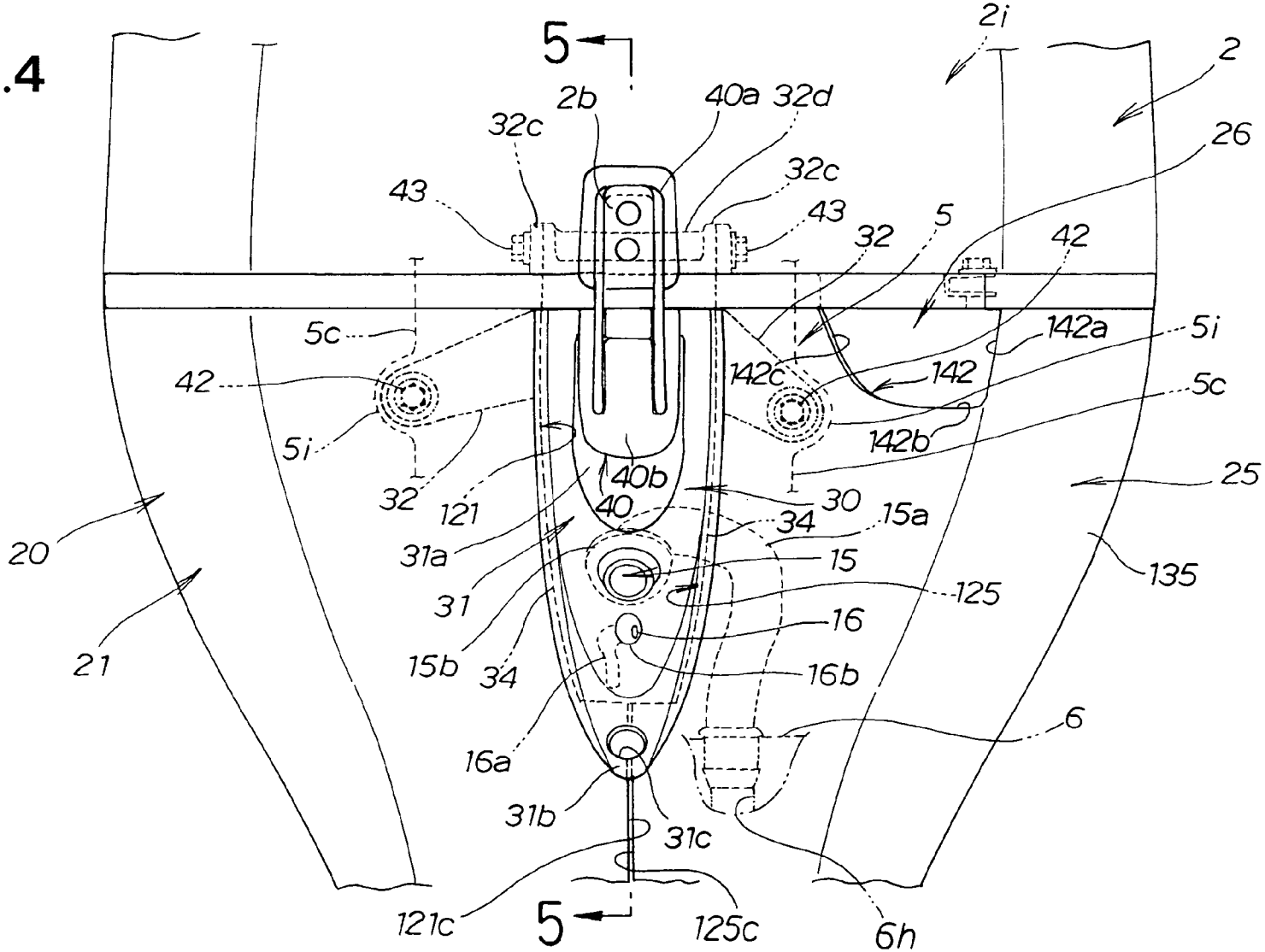
FIG. 4 is an enlarged rear view of principal components of the outboard engine unit shown in FIG. 2, which particularly shows supporting, by the rear bracket, of the upper cover and left and right cover halves of the lower cover.
Figure 5:
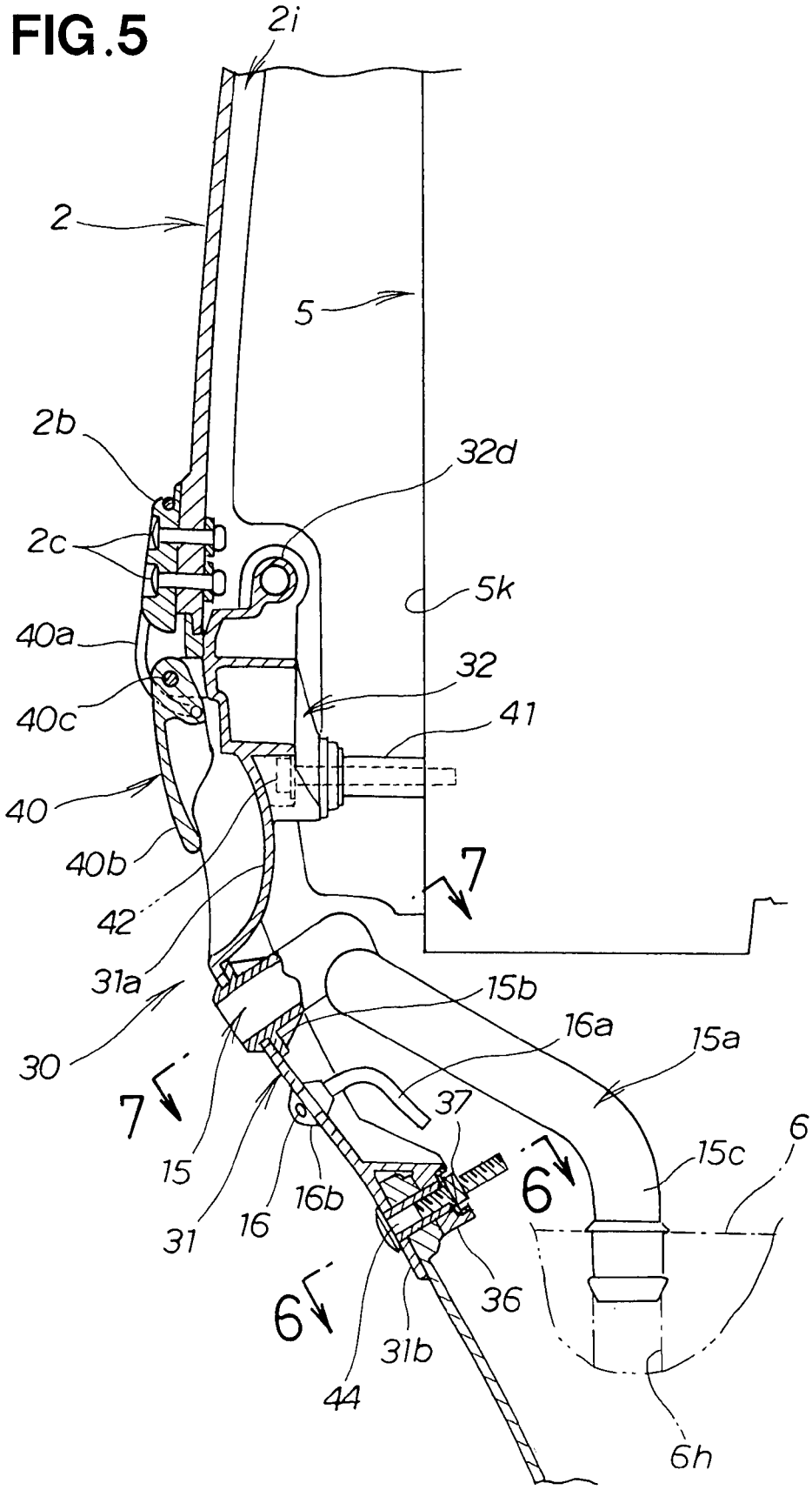
FIG. 5 is a sectional view taken along line 5-5 of FIG. 4.
Figure 6:
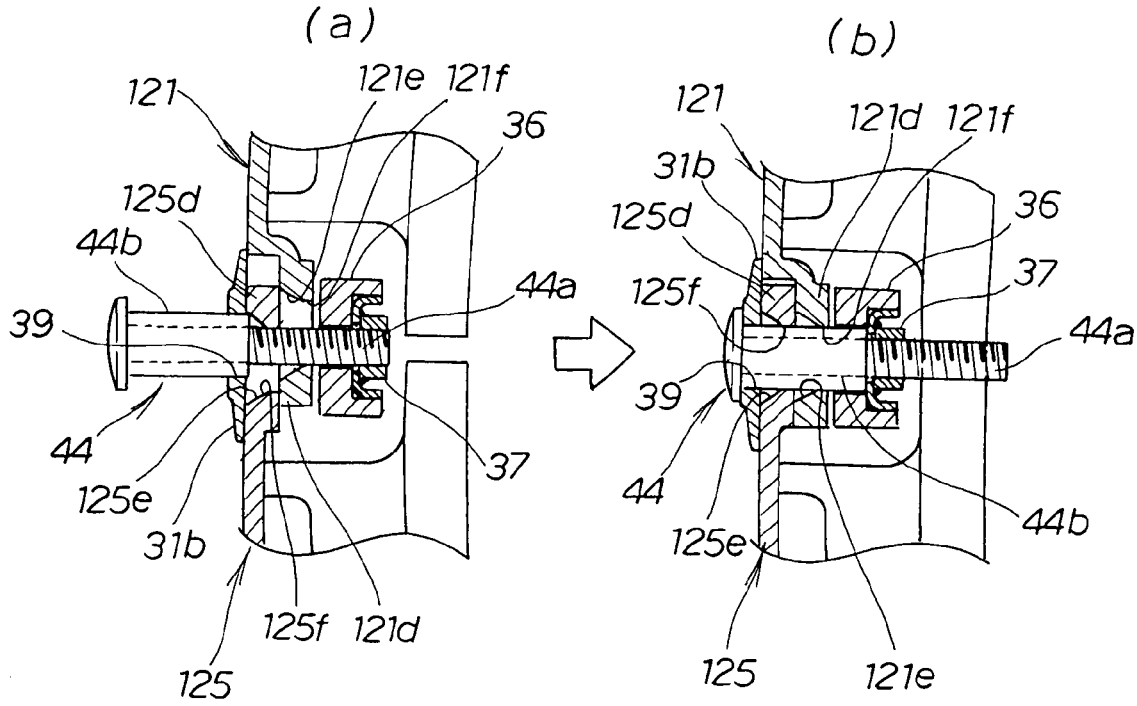
FIG. 6 is a sectional view taken along line 6-6 of FIG. 5.
Figure 7:
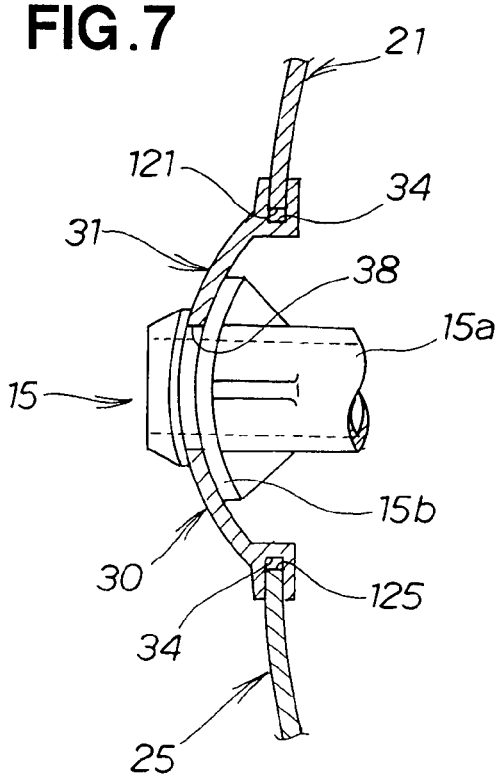
FIG. 7 is a sectional view taken along line 7-7 of FIG. 5.
Figure 8:
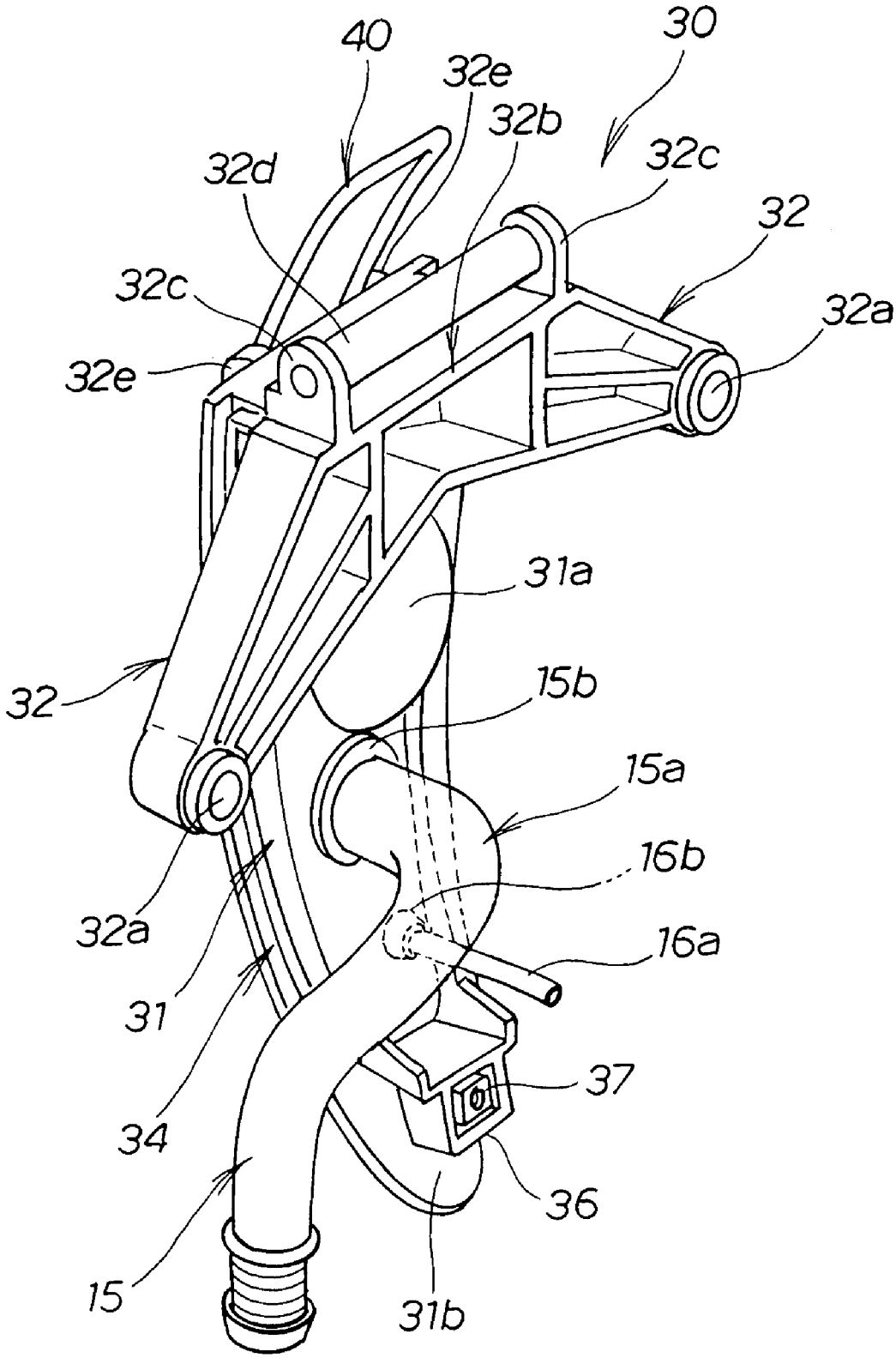
FIG. 8 is an inner perspective view showing components provided on and adjacent to the inner surface of the rear bracket.
Figure 9:
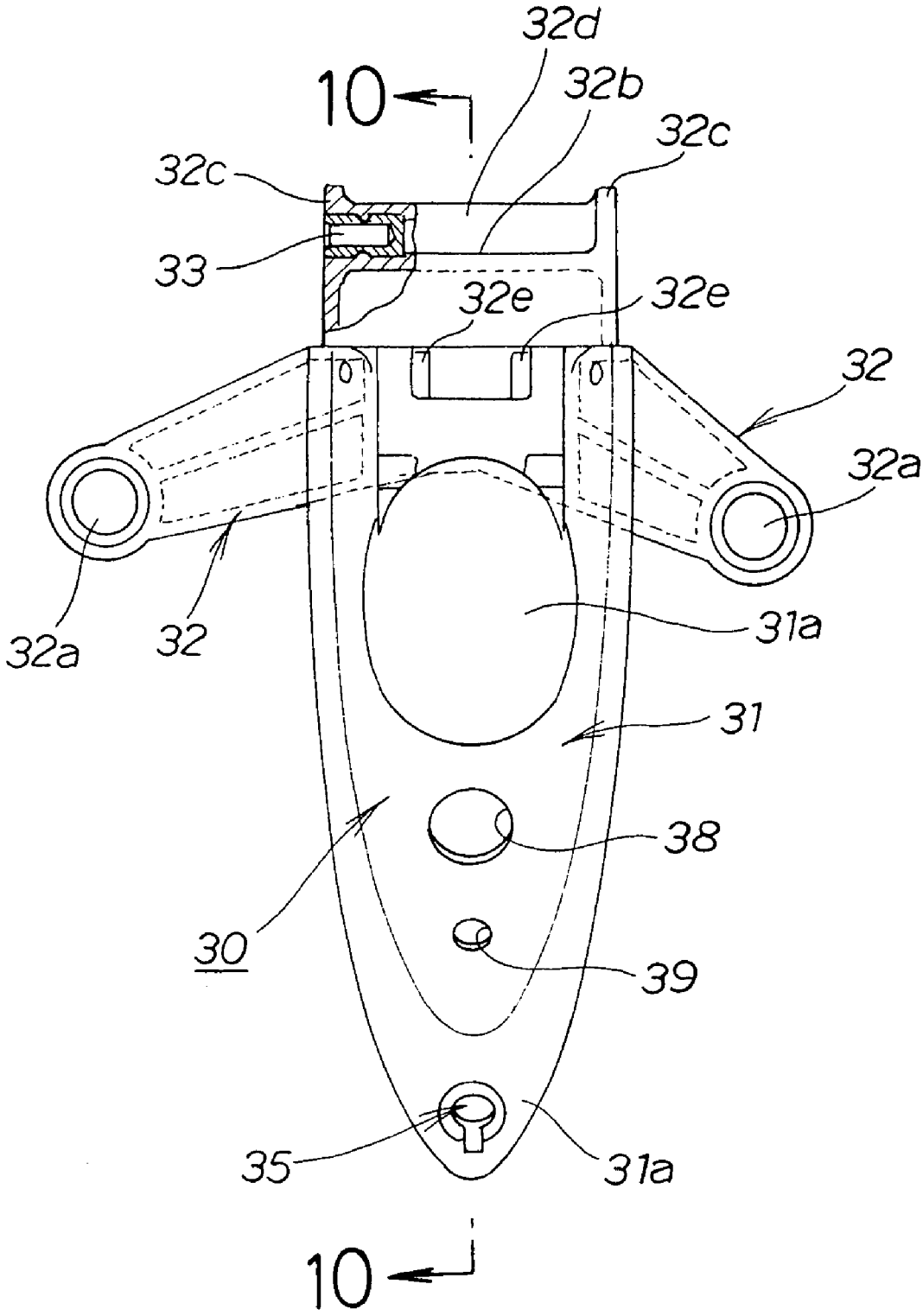
FIG. 9 is a perspective view of the rear bracket with an auxiliary exhaust port and water pilot hole section removed.
Figure 10:
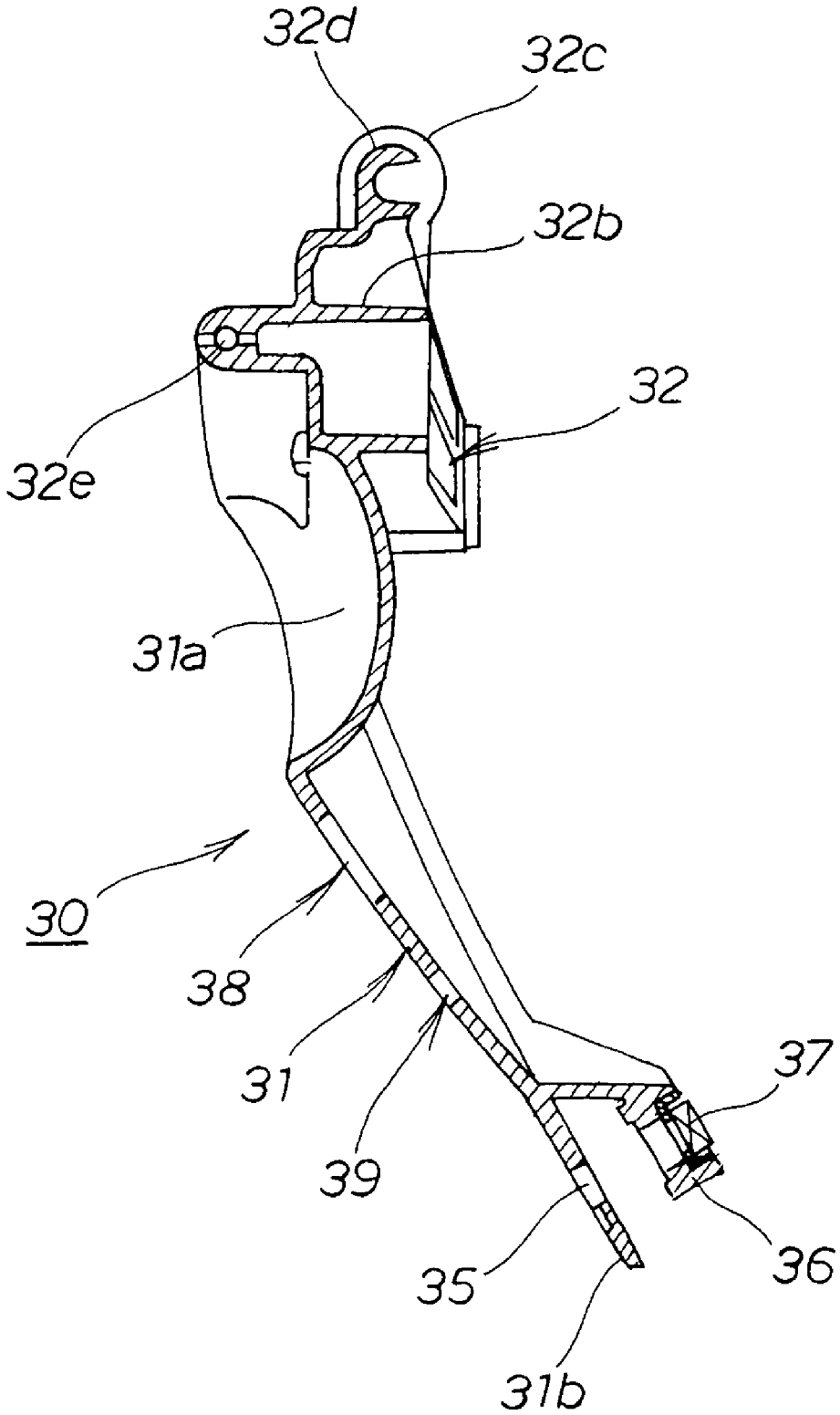
FIG. 10 is a sectional view taken along line 10-10 of FIG. 9.

FIG. 4 is an enlarged rear view of principal (or relevant) components shown in FIG. 2, which particularly shows supporting, by the rear bracket, of the upper cover 2 and left and right cover halves of the lower cover 20. FIG. 5 is a sectional view taken along the 5-5 line of FIG. 4, FIG. 6 is a sectional view taken along the 6-6 line of FIG. 5, and FIG. 7 is a sectional view taken along the 7-7 line of FIG. 5. Further, FIG. 8 is an inner perspective view showing components provided on and adjacent to the inner surface of the rear bracket 30, FIG. 9 is a perspective view of the rear bracket 30 with the auxiliary exhaust port and water pilot hole section removed therefrom, and FIG. 10 is a sectional view taken along the 10-10 line of FIG. 9.

The following paragraphs describe the rear bracket 30 and how the rear portions of the left and right cover halves 21 and 25 of the lower cover (assembly) 20 are mounted and supported, with reference to the above-mentioned figures.

The rear bracket 30 is provided for attaching the respective rear upper portions of the left and right cover halves 21 and 25 relative to the engine. Piping of the auxiliary exhaust port 15 and water pilot hole section 16 are exposed on the inner (or reverse) surface of the rear bracket 30.

The rear bracket 30 is elongated in shape in a vertical direction of the outboard engine unit 1. Body 31 of the rear bracket 30 is generally in the form of a plate having a gently-curved or downwardly-tapered lower half section, as viewed from the back (see FIG. 4); namely, the rear bracket body 31 generally has a shield shape as viewed from the back.

The plate-shaped body 31 of the rear bracket 30 has a vertically-intermediate recessed portion 31*a* that bulges forward (i.e., inwardly) as clearly seen in FIGS. 8 and 9. The recessed portion 31*a* constitutes a manual operation section of a later-described lock operation arm. Left and right mounting arm sections 32, projecting laterally away from each other and obliquely downward, are provided integrally with an upper inner surface portion of the body 31 and exposed toward a middle region of the rear surface of the lower cover 20; the left and right mounting arm sections 32 together form a downward dogleg configuration. The mounting arm sections 32 have respective mounting holes 32*a* at their respective distal ends and are formed, as a whole, as a rib-reinforced structure of a channel-like sectional shape.

Intermediate section 32*b* that is formed as a base of the left and right mounting arm sections 32 has left and right vertically-projecting portions 32*c* formed integrally therewith at opposite ends thereof. Cross holding section 32*d* extends between the projecting portions 32*c*, and mounting nuts 33 are embedded in opposite end portions of the holding section 32*d*. Hinge support portions 32*e* of the lock operation arm are provided, on an upper outer surface area of the plate-shaped body 31, for supporting a pivotal base of the operation arm 40.

Grooves 34 recessed inwardly in the width direction of the plate-shaped body 31 are provided in and along opposite side edges of the body 31, and the width of the recessed grooves 34 is slightly greater than the thickness of the cover halves 21 and 25.

Further, the plate-shaped body 31 has a bolt hole 35 formed in its lower end portion 31*b*, and a mounting boss portion 36 is provided integrally on an inner surface area of the body 31 corresponding in position to the bolt hole 35. Nut 37 is embedded in and fixed, by welding or otherwise, to the inner surface of the mounting boss portion 36.

The above-mentioned operation arm 40, operation lever 40*b* and shaft 40*c*, which are all provided on the rear bracket 30, together constitute a lock device of the engine cover 2 in conjunction with a locking hook 2*b* on the engine cover 2.

Hole 38 for mounting the auxiliary exhaust port or pipe 15 is formed in the plate-shaped body 31 beneath the above-mentioned recessed portion 31*a*, and a hole 39 for mounting the water pilot hole section 16 is formed beneath the mounting hole 38. The auxiliary-exhaust-pipe mounting hole 38 has a greater diameter than the water-pilot-section mounting hole 39. As seen from FIG. 4, the auxiliary exhaust port or pipe 15 and water pilot hole section 16 open to the rear surface of the bracket 30.

The auxiliary exhaust port 15 has an upstream portion 15*a* located adjacent to the inner surface of the plate-shaped body 31, and an upstream-end opening portion having a flange 15*b*. The flange 15*b* abuts against an area of the body's inner surface around the auxiliary-exhaust-pipe mounting hole 38. Further, a tube 16*a* of the water pilot hole section 16 is indicated by broken lines in FIG. 4 and projects forwardly or inwardly beyond the inner surface of the plate-shaped body 31, and a nozzle portion 16*b* of the water pilot hole section 16 is fitted in the hole 39, as seen from FIG. 8.

Now, with reference to FIGS. 4-7, a description will be given about how the rear bracket 30 and the engine 5 are mounted and the rear bracket 30 is connected with the cover halves 21 and 25.

As shown in FIG. 4, mounting seat portions 5*i*, projecting laterally outwardly away from each other, are provided on left- and right-side regions of a rear surface 5*k* of the cylinder head 5*c*, and the left and right mounting arm sections 32 projecting laterally outwardly from the plate-shaped body 31 are fixed to the mounting seat portions 5*i* by means of bolts 42, corresponding in size to the mounting holes 32*a*, via respective collars 41.

In the aforementioned manner, the rear bracket 30 is attached to (i.e., mounted and supported on) the rear surface of the engine 5. The rear bracket 30 may be attached the rear surface of the engine mount case 6 rather than to the engine 5.

Vertically-elongated engaging sections 121 and 125, each having a relatively small width in the left-right direction of the unit 1, are provided, in opposed (left-right symmetrical) relation to each other, above respective abuttingly-joining edges 121*c* and 125*c* of the left and right cover halves 21 and 25. Further, mounting bosses 121*a* and 125*a*, having horizontal mounting holes 121*b* and 125*b* formed therethrough, are provided to project vertically from opposed upper end portions of the engaging sections 121 and 125; the mounting bosses 121*a* and 125*a* are located in left-right symmetrical relation to each other.

The abuttingly-joining edges 121*c* and 125*c* of the left and right cover halves 21 and 25 are abutted against each other, and the side edges of the engaging sections 121 and 125 are fittingly engaged in the recessed grooves 34 formed in the left and right side edges of the plate-shaped body 31 of the rear bracket 30 (see FIG. 7).

The mounting bosses 121*a* and 125*a*, provided on the upper end portions of the engaging sections 121 and 125, are abutted against the corresponding vertically-projecting portions 32*c* formed on an upper surface region of the rear bracket 30. Then, bolts 43 are inserted in mounting holes 121*b* and 125*b* of the mounting bosses 121*a* and 125*a* laterally from the outer ends of the bosses 121*a* and 125*a*, and screwed in the mounting nuts 33. In this manner, the mounting bosses 121*a* and 125*a* are fixed to left and right upper end portions of the rear bracket 30, so that upper end portions of the left and right cover halves 21 and 25 are attached to (i.e., mounted and supported on) the bracket 30.

Decorative bolt is passed through a mounting hole formed in a lower end portion of the bracket body 31, and mounting holes 31*k* formed near the lower ends of the engaging sections 121 and 125 of the cover halves 21 and 25 (only the mounting hole 31*k* of the left cover half 21 is visible in FIG. 3) are overlapped with each other on the nut 37 (see FIG. 3) and secured together by means of the nut 37 as will be later described.

In the instant embodiment constructed in the above-described manner, only the body 31 of the bracket 30 is exposed on the rear surfaces of the upper cover and lower cover 20, and elements for mounting the various components to the engine 5 and left and right cover halves 21 and 25 are hidden by the covers.

Joining seat portions 121*d* and 125*d* are provided on and project from lower portions of the engaging sections 121 and 125 in horizontally opposed and overlapping relation to each other. One of the joining seat portions 121*d* is formed as a recessed portion bent inwardly into the engine room, and the other of the joining seat portions 125*d* has a wall thickness corresponding to the recessed depth of the one joining seat portion 121*d*. These joining seat portions 121*d* and 125*d* have respective outer surfaces lying flush with each other.

As shown in (a) of FIG. 6, the joining seat portions 121*d* and 125*d* have tapering hole portions 121*e* and 125*e* each having a greater diameter than a threaded portion 44*a* of a stepped bolt 44 and having a hole 121*f* or 125*f* formed therethrough. Greater-diameter portion 44*b* of the stepped bolt 44 is tightly passed through the through-holes 121*f* and 125*f*.

The joining seat portions 121*d* and 125*d* are initially positioned to partly overlap with each other in the front-rear direction of the unit 1 and to be displaced from each other in the left-right direction of the unit 1; thus, the tapering hole portions 121*e* and 125*e* are initially displaced from each other in the left-right direction, as shown in (a) of FIG. 6.

The bolt 44 is inserted through the hole 39 formed in a lower end portion of the plate-shaped body 31 of the bracket 30 so that the bolt's threaded portion 44*a* is loosely passed through the holes 121*f* and 125*f* of the joining seat portions 121*d* and 125*d* and then screwed into the nut 37 fixed, by welding or otherwise, to the mounting boss portion 36 fixedly provided on an inner surface area of the body 31. The nut 37 functions as a fixed threaded member.

As the screwing, into the nut or fixed threaded member 37, of the bolt 44 progresses, the greater-diameter portion 44*b* of the bolt 44 reaches the tapering hole portion 121*e* of the inner joining seat portion 121*d* by way of the tapering hole portion 125*e* of the outer joining seat portion 125*d*, so that the two seat portions 121*d* and 125*d* are gradually drawn closer to each other through aligning action. Ultimately, the engaging sections 121 and 125 are coupled together in the lower end portion of the bracket 30 with the holes 12 if and 125*f* held in axial alignment and seat portions 121*d* and 125*d* held in face-to-face abutted relation to each other, as shown in (b) of FIG. 6.

As shown in FIG. 5, the locking hook 2*b* is provided on a lower rear surface area of the upper cover 2 in vertically opposed relation to the operation arm 40. The lock lever 40*a* is caused to engage the locking hook 2*b* through pivoting, about the shaft 40*c*, of the operation lever 40*b* of the operation arm 40, to thereby lock the back of the engine cover 2 in a closed position, i.e. fix the upper cover 2 to the lower cover 20 in a closed position.

In FIG. 5, the locking hook 2*b* is fastened to the back of the engine cover 2 by means of rivets 2*c*. In FIGS. 4 and 5, reference numeral 6*h* represents an auxiliary exhaust passageway provided in the engine mount case 6 and communicating at one end with a downstreammost portion 15*c* of the auxiliary exhaust port 15, to thereby allow a portion of the engine exhaust to flow to the auxiliary exhaust port 15.

Because the auxiliary exhaust port 15 and water pilot hole section 16 are provided in the rear bracket 30, supporting the lower cover 20, as described above, the instant embodiment can eliminate the need to detach the piping of the auxiliary exhaust port 15, water pilot hole section 16, sealing members, etc. from the lower cover 20 when the lower cover 20 is to be detached for desired work. Thus, in the instant embodiment, no operation for re-attaching the piping of the auxiliary exhaust port 15, water pilot hole section 16, sealing members, etc. is required after the desired work. Therefore, even in the case where the auxiliary exhaust port 15, water pilot hole section 16 are provided, it is only necessary to perform operation for detaching the lower cover 20 for desired work.

Further, in the instant embodiment, the left and right cover halves 21, 25 of the lower cover 20 are mounted and supported on the rear bracket 30 independently of each other. Thus, even when one of the left and right cover halves 21 or 25 is detached from the bracket 30, the other of the left and right cover halves 25 or 21 is still kept attached to the rear bracket 30, which can facilitate the detachment of the one cover half and subsequent re-attachment of the one cover half.

In FIGS. 1, 2 and 4, reference numeral 26 represents an ignition plug maintenance lid provided on an uppermost region of the rear surface of one of the left and right lower cover halves (right lower cover half 25 in the above-described embodiment). By detaching the ignition plug maintenance lid 26, the ignition plug can be exposed to the engine combustion chamber defined in the cylinder head of any one of the cylinders disposed in a vertical arrangement, so that checking, replacing operation, etc. of the plug can be performed with ease; at that time, the engine cover 2 located over the lower cover 20 need not be detached.

Further, when checking etc. of the ignition plugs, disposed in a vertical arrangement in correspondence with the cylinders, is to be performed with the engine cover 2 removed, it would be difficult to check some of the plugs, located in a lower position in the vertical arrangement, due to the presence of the lower cover. However, detaching the lid 26 can facilitate such plug checking.

Figure 11:
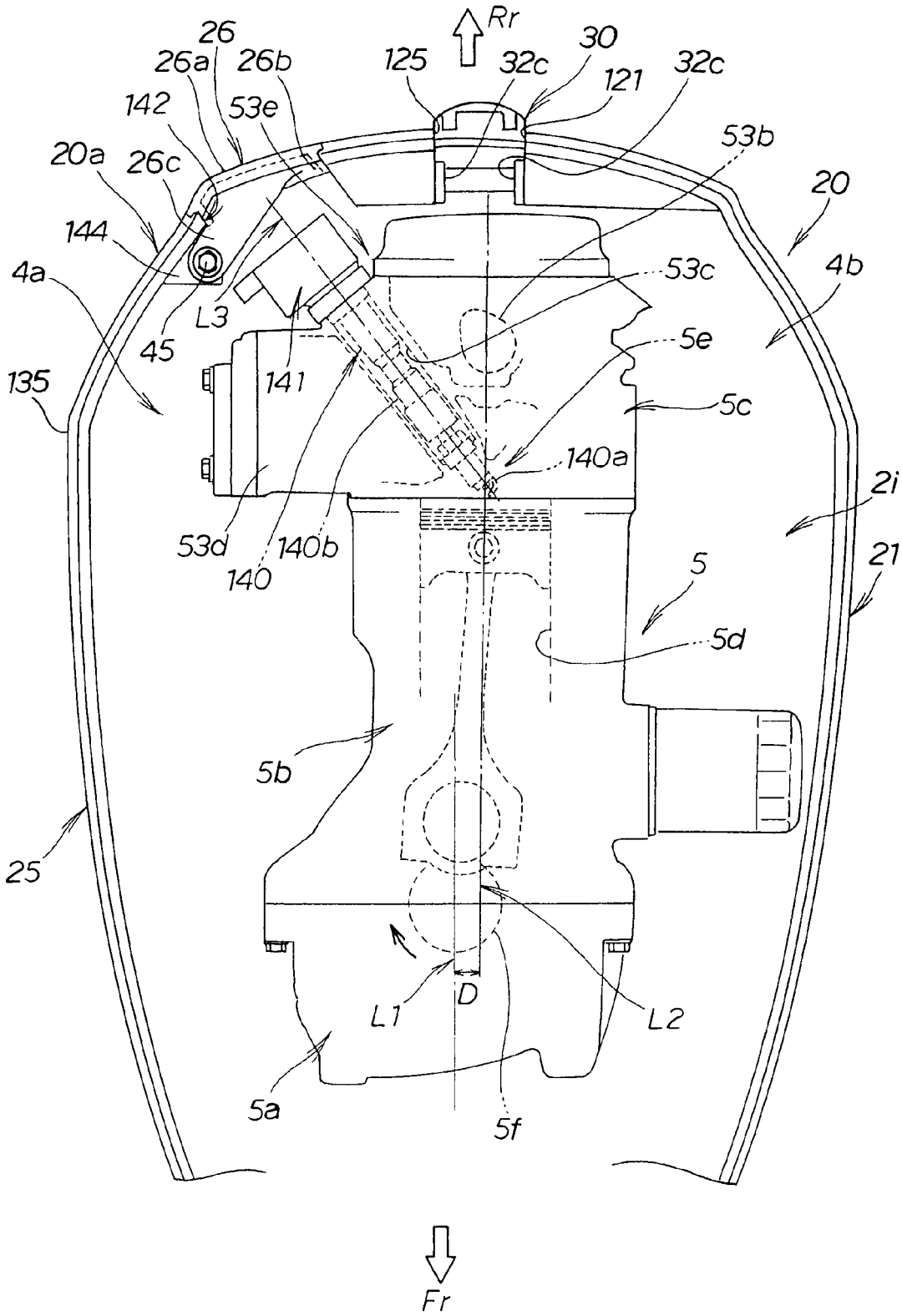
FIG. 11 is a view showing the lower cover with the upper or engine cover removed for clarity and with a front section of the lower cover taken away.
Figure 12:
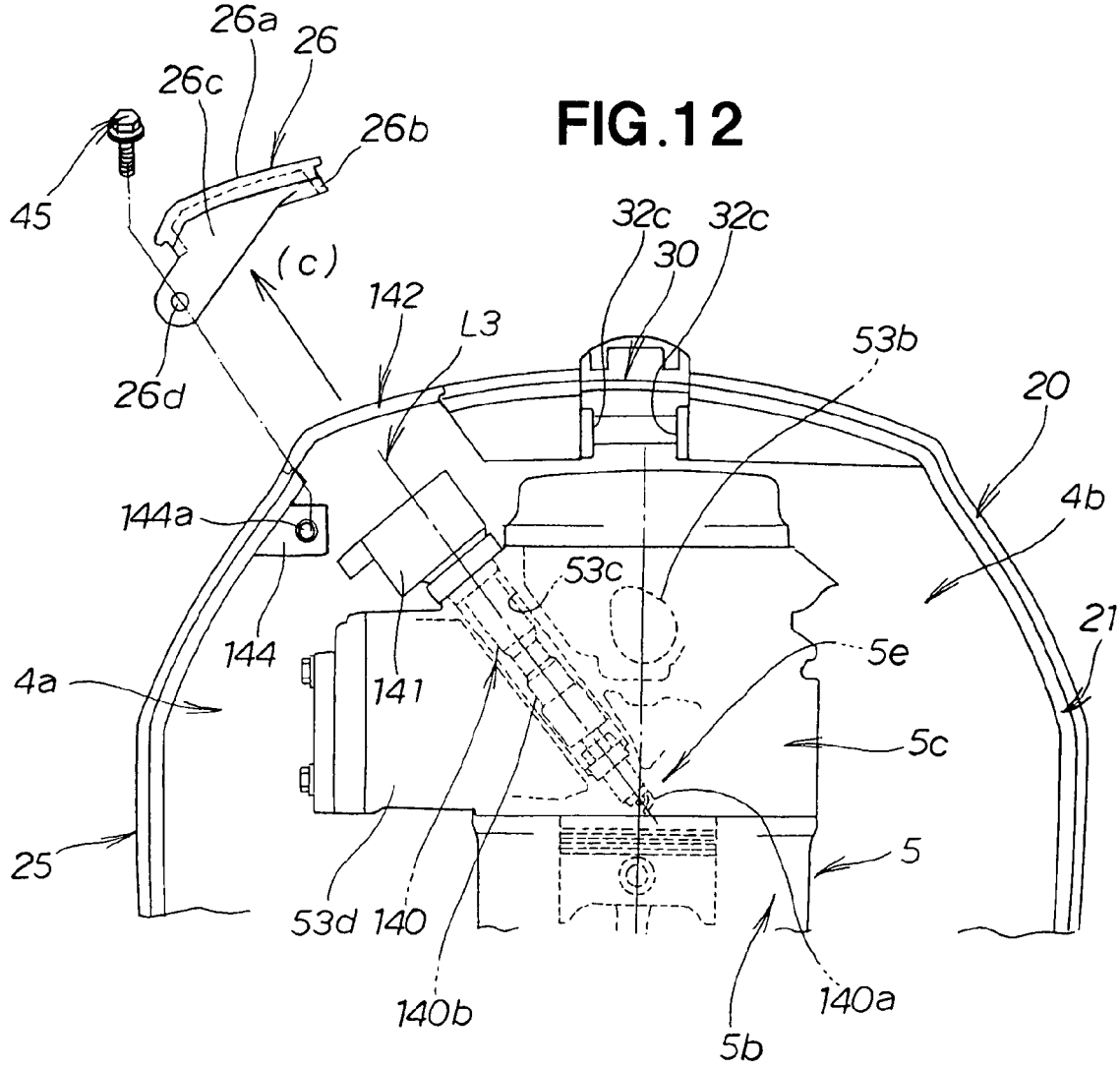
FIG. 12 is an enlarged exploded view explanatory of principal elements shown in FIG. 11.

FIG. 11 is a view showing the lower cover (assembly) 20 with the upper or engine cover 2 removed and a front section of the lower cover 20 taken away for convenience of illustration, and FIG. 12 is an enlarged exploded view explanatory of principal elements shown in FIG. 11.

The crankcase 5*a* of the engine 5 is located in a front area of the engine room 2*i*, the cylinder block 5*b* in a middle area f the engine room 2*i*, and the cylinder head 5*c* and cylinder head cover (not shown) are located in a rear area of the engine room 2*i*.

Centerline L2 of the cylinder 5*d* in the cylinder block 5*b*, extending in the front-rear direction of the outboard engine unit 1, is displaced or offset from a centerline L1 of the unit 1, extending centrally across the width of the unit 1, by a distance D toward the left or port side of the unit 1 (right side in FIG. 11).

As seen in FIG. 11, the centerline L1 of the outboard engine unit 1 corresponds with the center of the crankshaft 5*f* and the center of the drive shaft 12, and it also agrees with a centerline of the engine room 2*i* centrally across the width of the engine room 2*i*. The crankshaft 5*f* rotates in a direction arrowed in FIG. 11.

Thus, the engine 5, including the cylinder head 5*c*, is offset toward the left or port side of the unit 1 (right side in FIG. 11), so that a right-side (i.e., starboard-side) space (left-side space in FIG. 11) 4*a* is greater than a left-side (i.e., port-side) space (right-side space in FIG. 11) 4*b*.

Hole 53*c* for mounting therein the ignition plug 140, communicating with the combustion chamber 5*e*, is formed in the cylinder head 5*c* to extend obliquely rearwardly in the greater space 4*a*, and the ignition plug 140 is passed through the hole 53*c*.

The ignition plug 140 includes an electrode section 140*a* provided at its distal end and located within the combustion chamber 5*e*, and a shaft-shaped body 140*b* having an insulating material and extending obliquely upward through the mounting hole 53*c*. Terminal provided at the top of the shaft-shaped body 140*b* is connected, via a high-tension cord, to a terminal provided within a cap-shaped head section 141, and it is supplied with electric power from the terminal within the head section 141.

The plug's head section 141 projecting outward from the cylinder head 5*c* is located in an L-shaped space 53*e* defined between an exhaust passage portion 53*d* in the cylinder head 5*c* and the ceiling of the cylinder head 5*c* (i.e., surface abutted against the cylinder head cover). The head section 141 faces, or is oriented toward, a starboard- or right-side (left-side in the figure) rear surface 20*a*, but it is never oriented toward the rear joint section where the left and right cover halves 21 and 25 are joined together via the rear bracket 23. Axis line L3 of the ignition plug 140 and mounting hole 53*c* are oriented toward a starboard- or right-side rear region displaced from the rear bracket 31.

Recessed section 142 is formed in an upper region of the rear surface 135 (FIG. 4) of one of the lower cover halves which is located on an extension of the axis line L3 of the ignition plug 140, i.e. the right or starboard-side cover half deft one in the figure) 25.

The recessed section 142 is in the form of an upwardly-opening recess provided to correspond to the above-mentioned axis line L3 of the ignition plug 140, i.e. a direction in which the ignition plug 140 is to be pulled out from the hole 53*c* and hence the cover half 25 (i.e., "pulled-out direction" of the plug 140). As seen in FIG. 4, the recessed section 142 in the instant embodiment has a substantially-linear outer edge 142*a*, a gently-curved bottom edge 142*b*, and an inner side edge 142*c* curved upwardly and inwardly.

The recessed section 142 opens upwardly, as noted above, with its left and right upper edges merging with a rear upper edge of the cover half 25, and this recessed section 142 is openable and closeable with the above-mentioned lid 26 corresponding in shape to the recessed section 142.

As seen in FIG. 12, the lid 26 includes a plate-shaped body 26*a* corresponding in shape to the recessed section 142, a reinforcing rib 26*b* formed on and along the periphery of its inner surface, and an arm portion 26*c*. The arm portion 26*c* has a mounting hole 26*d* formed in its one end region.

Supporting stay 144 is provided on the inner surface of the right cover half 25 adjacent to the outer edge of the recessed section 142, and the supporting stay 144 has a mounting screw hole 144*a*. Bolt 45 is passed through the mounting hole 26*d* of the lid 26 into threaded engagement with the mounting screw hole 144*a*, to thereby fix the lid 26 to the recessed section 142 in a closed position. In FIGS. 11 and 12, reference numeral 53*b* represents a camshaft.

The lid 26 can be detached from the recessed section 142 by removing the upper or engine cover 2 and bolt 45, as illustrated in FIG. 12.

The ignition plug 140, which has its axis line L3 orientated toward the recessed section 142, can be pulled out from the recessed section 142 as indicated by arrow (c). Because the space 4*a* is relatively great, not only the ignition plug 140 can be inserted to and pulled out from the hole 53*c* with ease, but also the exhaust passage portion 53*d* of the cylinder head 5*c* etc. can be installed in position with ease.

Further, because the left and right cover halves 21 and 25 are attached at their respective upper portions to the rear bracket 30 and because the bracket 30 is not located in the direction where the ignition plug 140 is to be inserted to and pulled out from the hole 53*c* (i.e., the inserted/pulled-out direction of the plug 140 does not correspond to the location of the rear bracket 30), the insertion/removal of the plug 140 will never be interfered with by the presence of the rear bracket 30.

The above-described lower-cover mounting construction is suitably applicable to lower covers of outboard engine units. Further, the above-described positioning and orientation of the ignition plug, the recessed section for maintenance of the plug and the lid for opening/closing the recessed section are suitably applicable to outboard engine units.

Obviously, various minor changes and modifications of the present invention are possible in light of the above teaching. It is therefore to be understood that within the scope of the appended claims the invention may be practiced otherwise than as specifically described.

What is claimed is:

1. An outboard engine unit comprising:

a cover assembly defining a lower half of an engine room having an engine accommodated therein, said cover assembly comprising left and right cover members each formed of resin; and a bracket fixed to a rear portion of the engine or engine support structure, said left and right cover members being fixedly attached at respective rear portions thereof to said bracket, wherein said bracket has grooves formed in opposite side edges thereof, for engaging predetermined joining edges of said left and right cover members.

2. The outboard engine unit of claim 1, wherein said left and right cover members have respective joining portions overlapping with each other, each of the joining portions having a tapering hole, said left and right cover members are fastened together by a bolt screwed through respective ones of the tapering holes, initially displaced from each other in a left-right direction of said outboard engine unit, to a predetermined fixed threaded portion to tighten the respective joining portions against said bracket and thereby press said left and right cover members toward each other.

3. An outboard engine unit comprising:

a cover assembly defining a lower half of an engine room having an engine accommodated therein, said cover assembly comprising left and right cover members each formed of resin; and a bracket fixed to a rear portion of the engine or engine support structure, said bracket having an auxiliary exhaust port provided therein for discharging a portion of exhaust of the engine to outside of the engine room, wherein said left and right cover members are connected at respective rear portions thereof to said bracket.

4. The outboard engine unit of claim 3, wherein said left and right cover members have respective joining portions overlapping with each other, each of the joining portions having a tapering hole, said left and right cover members are fastened together by a bolt screwed through the tapering holes, initially displaced from each other in a left-right direction of said outboard engine unit, to a predetermined fixed threaded portion to tighten the respective joining portions against said bracket and thereby press said left and right cover members toward each other.

5. The outboard engine unit of claim 3, wherein said bracket has a lock device provided thereon for locking an engine cover.

6. An outboard engine unit comprising:

a cover assembly defining a lower half of an engine room having an engine accommodated therein, said cover assembly comprising left and right cover members each formed of resin; and a bracket fixed to a rear portion of the engine or engine support structure, said bracket having a water pilot hole provided therein for discharging a portion of cooling water of the engine to outside of the engine room wherein said left and right cover members are connected at respective rear portions thereof to said bracket.

7. The outboard engine unit of claim 6, wherein said left and right cover members have respective joining portions overlapping with each other, each of the joining portions having a tapering hole, said left and right cover members are fastened together by a bolt screwed through respective ones of the tapering holes, initially displaced from each other in a left-right direction of said outboard engine unit, to a predetermined fixed threaded portion to tighten the respective joining portions against said bracket and thereby press said left and right cover members toward each other.

8. The outboard engine unit of claim 6, wherein said bracket has a lock device provided thereon for locking an engine cover.

9. An outboard engine unit comprising:

an engine room having an engine accommodated therein, a centerline of an engine cylinder being offset from a centerline of said engine room toward one of left and right sides of said outboard engine unit; and an ignition plug provided on other of the left and right sides, opposite from the one side toward which the centerline of the engine cylinder is offset, wherein said engine room is defined by a lower cover and an engine cover joined to said lower cover from above, and said lower cover has a recessed section formed in a portion thereof coinciding with a pulled-out direction of said ignition plug, said recessed section being openable/closeable by a lid.

10. The outboard engine unit of claim 9, wherein said lower cover comprises left and right cover members each formed of resin, and one of the left and right cover members has said recessed section formed therein and the lid provided thereon.

11. The outboard engine unit of claim 10, which further comprises a bracket fixed to a rear portion of the engine or engine support structure, and wherein the left and right cover members of said lower cover are fixed to said bracket, and said ignition plug is disposed in such a manner that the pulled-out direction does not coincide with a location of said bracket.

* * * * *